US009488377B2

(12) United States Patent
Wie et al.

(10) Patent No.: US 9,488,377 B2
(45) Date of Patent: Nov. 8, 2016

(54) GAS OVEN RANGE

(71) Applicant: LG ELECTRONICS INC., Seoul (KR)

(72) Inventors: Jeahyuk Wie, Changwon-si (KR); Youngsoo Kim, Changwon-si (KR); Yangho Kim, Changwon-si (KR); Ingyu Yang, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 407 days.

(21) Appl. No.: 14/086,436

(22) Filed: Nov. 21, 2013

(65) Prior Publication Data

US 2014/0144423 A1 May 29, 2014

(30) Foreign Application Priority Data

Nov. 27, 2012 (KR) ..... 10-2012-0135283

(51) Int. Cl.
*F24C 3/08* (2006.01)
*F24C 15/32* (2006.01)

(52) U.S. Cl.
CPC ..... *F24C 15/322* (2013.01); *F24C 3/087* (2013.01)

(58) Field of Classification Search
CPC ..... F24C 15/322; A21B 1/26; A47J 39/003
USPC ..... 126/273 R
See application file for complete search history.

(56) References Cited

U.S. PATENT DOCUMENTS 3,590,803 A * 7/1971 Sauer ..... F24C 15/322 126/11
3,719,180 A * 3/1973 Pere ..... A21B 1/26 126/21 A
3,991,737 A * 11/1976 Del Fabbro ..... F24C 15/322 126/21 A
4,430,541 A * 2/1984 Day, Jr. ..... F24C 15/322 126/21 A
4,498,453 A * 2/1985 Ueda ..... F24C 15/322 126/21 A (Continued)

FOREIGN PATENT DOCUMENTS

JP 10-038280 A 2/1998
JP 10-332150 A 12/1998

(Continued)

OTHER PUBLICATIONS

Korean Office Action dated Jan. 27, 2014 issued in Application No. KR 10-2012-0135283.

(Continued)

*Primary Examiner* — Jorge Pereiro
(74) *Attorney, Agent, or Firm* — Ked & Associates, LLP

(57) ABSTRACT

A gas oven range may include a cavity forming a cooking chamber in which food may be cooked, and a burner assembly installed in the cavity. The burner assembly may include a burner having flame holes formed therein, and a cover covering the burner to form a burner chamber. The cover may include an inlet that guides air from the cooking chamber into the burner chamber and an outlet that discharges air heated by the burner. An air inlet may be formed at one wall of the cavity to introduce external air into the burner chamber.

20 Claims, 7 Drawing Sheets

(56) References Cited

U.S. PATENT DOCUMENTS 4,627,409 A * 12/1986 Kagomoto ..... F24C 15/322 126/19 R
4,722,683 A * 2/1988 Royer ..... F24C 15/325 126/21 A
4,813,398 A * 3/1989 Savage ..... F24C 15/322 126/21 A
4,823,766 A * 4/1989 Violi ..... F24C 15/327 126/20
4,867,132 A * 9/1989 Yencha ..... F24C 15/322 126/21 A
4,926,837 A * 5/1990 Parker ..... F24C 1/04 126/21 A
5,016,605 A * 5/1991 LaForet ..... F24C 15/322 126/20
5,016,606 A * 5/1991 Himmel ..... F24C 15/322 126/21 A
5,121,737 A * 6/1992 Yencha, III ..... F24C 15/322 126/21 A
5,222,474 A * 6/1993 Yencha, III ..... F24C 15/322 126/21 A
5,568,803 A * 10/1996 Brown ..... F24C 15/322 126/21 A
6,371,104 B1 * 4/2002 Voohris ..... F24C 15/322 126/21 A
7,325,480 B2 * 2/2008 Gruhbaum ..... F24C 15/322 99/330

FOREIGN PATENT DOCUMENTS

JP 4439304 B2 1/2010
KR 10-0889132 B1 3/2009

OTHER PUBLICATIONS

Korean Notice of Allowance dated Jul. 29, 2014 issued in Application No. 10-2012-0135283.

* cited by examiner

GAS OVEN RANGE

CROSS-REFERENCE TO RELATED APPLICATION(S)

This application claims priority under 35 U.S.C. §119 to Korean Application No. 10-2012-0135283, filed in Korea on Nov. 27, 2012, whose entire disclosure is hereby incorporated by reference.

BACKGROUND

1. Field

This relates to a gas powered cooking appliance.

2. Background

A gas oven range is a cooking appliance that cooks food using gas. Such a gas oven range may include a cooking chamber in which the food is cooked, and a burner that burns the gas for heating the cooking chamber. A burner chamber may be provided below a bottom surface of the cooking chamber, with a burner for convectively heating the cooking chamber installed in the burner chamber.

BRIEF DESCRIPTION OF THE DRAWINGS

The embodiments will be described in detail with reference to the following drawings in which like reference numerals refer to like elements wherein.

DETAILED DESCRIPTION

Reference will now be made in detail to various embodiments, examples of which are illustrated in the accompanying drawings.

In the following detailed description, reference is made to the accompanying drawings that form a part hereof, and in which is shown by way of illustration various embodiments. These embodiments are described in sufficient detail to enable those skilled in the art, and it is understood that other embodiments may be utilized and that logical structural, mechanical, electrical, and chemical changes may be made without departing from the spirit or scope as broadly described herein. To avoid detail not necessary to enable those skilled in the art, the description may omit certain information known to those skilled in the art. The following detailed description is, therefore, not to be taken in a limiting sense.

In a gas oven range, a burner chamber housing a gas burner may be provided below a cooking chamber in which items are received for cooking. The cooking chamber and the burner chamber may communicate with each other through openings in the bottom surface of the cooking chamber in order to transfer air heated by the burner from the burner chamber to the cooking chamber. While these openings may provide for effective transfer of heat from the burner chamber to the cooking chamber, food and other matter may flow into the burner chamber through the openings while the food is cooked in the cooking chamber and/or received into and/or removed from the cooking chamber, causing possible contamination and malfunction of the burner. These openings in the bottom surface of the cooking chamber may also make it difficult to clean the cooking chamber. Further, installation of the burner below the cooking chamber may detract from capacity of the cooking chamber.

Figure 1A:
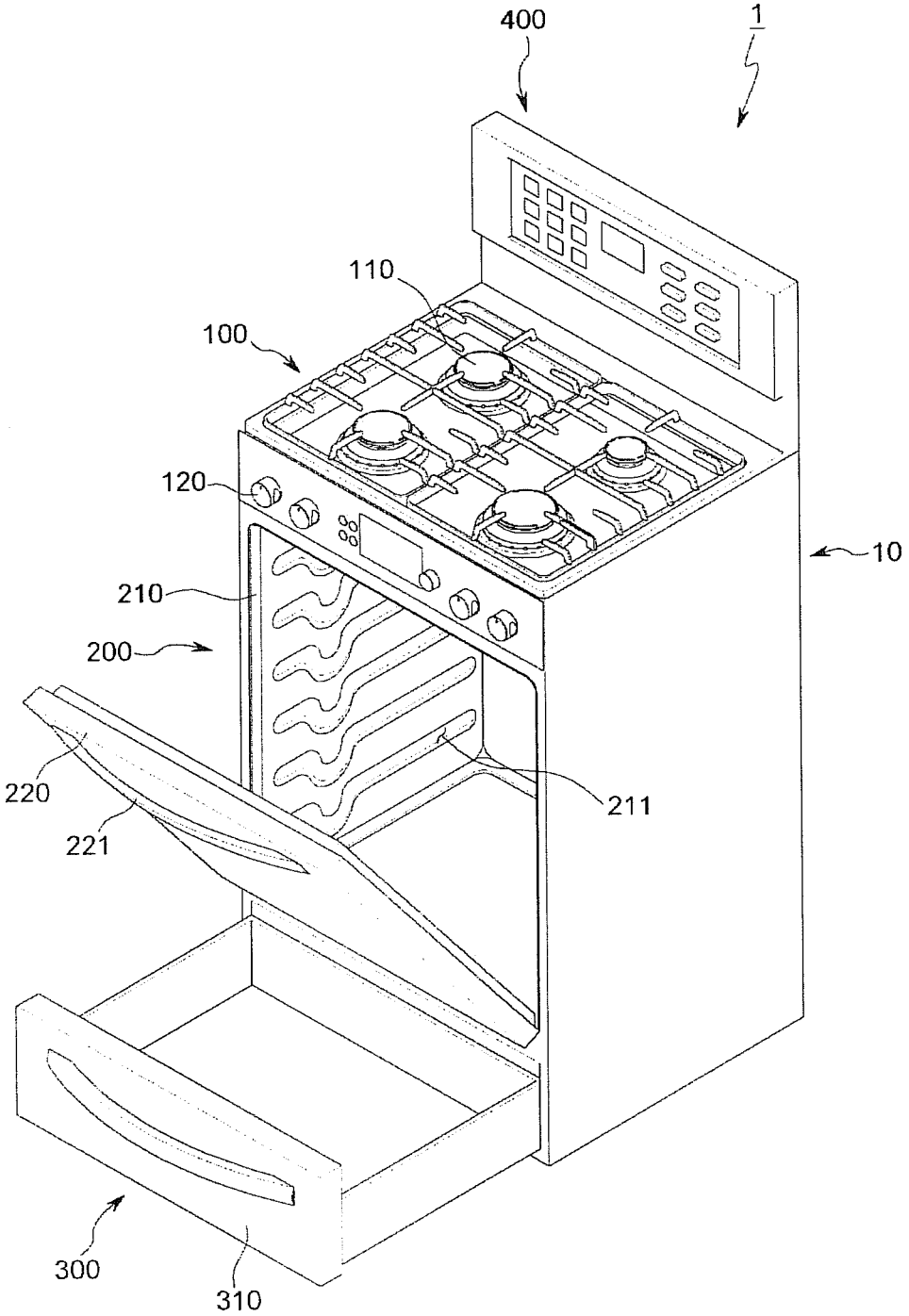
FIGS. 1A and 1B are perspective views of exemplary gas oven ranges, in accordance with embodiments as broadly described herein.
Figure 1B:
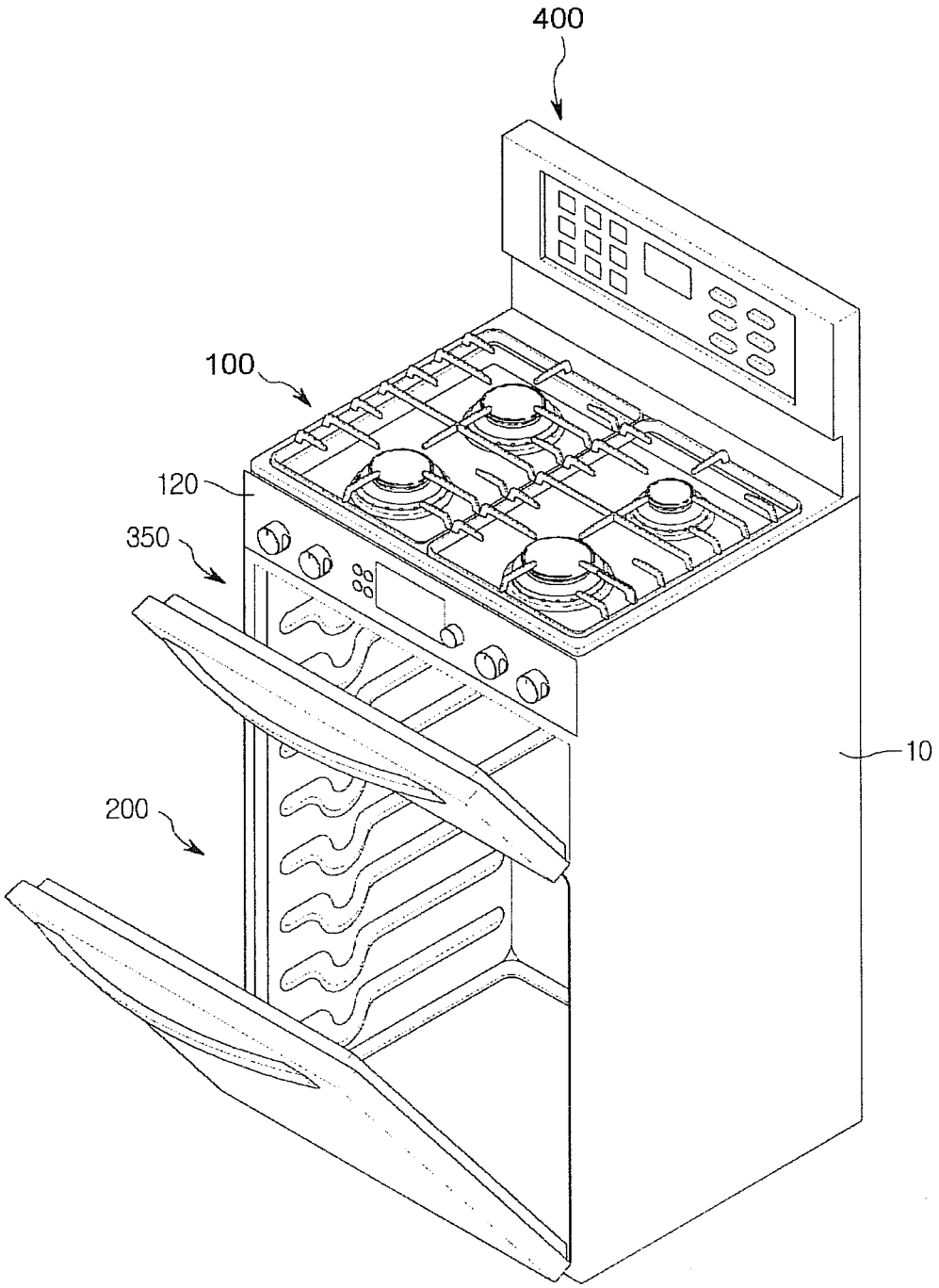

Referring to FIGS. 1A and 1B, a gas oven range 1 as embodied and broadly described herein may include a main body 10, a cooktop 100, a main oven 200, and a controller 400. As shown in FIG. 1A, a drawer 300 may be slidably coupled to the main body 10. As shown in FIG. 1B, an auxiliary oven 350 may be provided above the main oven 200. In certain embodiments, the cooktop 100 and/or the drawer 300 and/or the auxiliary oven 350 may be omitted based on a kind and installation. Further, the gas oven range 1 may include a plurality of ovens 200. The cooktop 100, the oven 200, and the drawer 300 may be arranged at an upper part, a central part, and a lower part of the main body 10, respectively, as in the exemplary embodiment shown in FIG. 1A. Similarly, the cooktop 100, auxiliary oven 350 and main oven 200 may be arranged as shown in FIG. 1B, or other arrangement as appropriate. The controller 400 may be provided, for example, at a rear end of an upper surface of the main body 10, as in the exemplary embodiment shown in FIG. 1, or other location as appropriate.

The cooktop 100 may include a plurality of cooktop burner 110 to directly heat containers in which food is received using flames generated by burning gas. A plurality of knobs 120 may be provided at a front end of the cooktop 100 to open or close a valve controlling a supply of gas to the cooktop burner 110, or a supply amount, or an opening degree of the valve.

The oven 200 may include a cavity 210 forming a cooking chamber 211. The cavity 210 may include two opposite lateral side walls, an upper wall, a rear wall, and a bottom wall, with the front surface of the cavity 210 opened. The oven 200 may also include an oven door 220 opening and closing the cooking chamber 211. The oven door 220 may be rotatably connected to the main body 10. For example, the oven door 220 may open and close the cooking chamber 211 by a pull-down method in which an upper end vertically pivots about the lower end thereof. However, an operating method of the oven door 220 is not limited to this. A door handle 221 to be grasped by a user may be provided at an upper front end of the oven door 220 in order to facilitate rotation of the oven door 220.

The drawer 300 may keep a container, in which food is received warm at a predetermined temperature. The drawer 300 may be slidably received in the main body 10. The auxiliary oven 350 may be capable of being rapidly heated to a desired temperature, and may be suitable for broiling.

The controller 400 may receive an operating signal for operating the gas oven range 1, for example, an operating signal for operating at least one of the cooktop 100, and/or the oven 200, and/or the drawer 300 and/or the auxiliary oven 350. The controller 400 may also externally display various information related to the operation of the gas oven range 1.

Referring to FIGS. 2 to 5, a burner assembly 230 for generating heat to be provided to the cooking chamber 211 may be provided on the rear wall 216 of the cavity 210. The burner assembly 230 may be coupled with the rear wall 216 of the cavity 210 in the cooking chamber 211.

A recessed portion 213 for increasing a capacity of the cavity 210 may be formed in the bottom wall 212 of the cavity 210, as a part of the bottom wall 212 that is recessed downward. That is, in this embodiment, since the burner assembly 230 is installed at the rear wall 216 of the cavity 210, and not below the cavity 210, the recessed portion 213 may be formed at the bottom wall of the cavity 210 to increase the capacity of the cavity 210.

The burner assembly 230 may include a burner 240 which may generate flames by burning gas, a plate 250 supporting the burner 240, a fan 260 for blowing air heated by the flames into the cooking chamber 211, a cover 270 covering the burner 240, and a fan motor 280 for rotating the fan 260. A discharge port 290 for discharging the burned gas may be provided at the rear wall 216 of the cavity 210.

The burner 240 may include a burner body 242 and a supply duct or pipe 244 supplying a gas and air mixture to the burner body 242. The burner body 242 may be somewhat rounded to increase a flame generation area. For example, the burner body 242 may have a "U"-like shape. However, various other shapes, such as circular or elliptical, may also appropriate.

The burner body 242 may have a hollow cylindrical shape, and a plurality of flame holes 243 may be formed on an outer peripheral surface (a surface having a relatively large length) of the burner body 242. In this embodiment, the plurality of flame holes 243 is formed on the outer peripheral surface of the burner body 242 to avoid interference between flames generated by adjacent flame holes 243.

One or more protrusions 245 for penetrating the plate 250 may be formed at the burner body 242.

The supply duct 244 may be connected to a lower portion of the burner body 242. The mixed gas supplied from the supply duct 244 may be divided and flow into the two opposite sides of the burner body 242. In this embodiment, the mixed gas is divided to flow into the burner body 242 so that the flames may be evenly generated throughout the burner body 242. The supply duct 244 may penetrate the rear wall 216 of the cavity 210 and extend to a rear side of the rear wall 216. In addition, a nozzle may be disposed at a position aligned with the supply duct 244.

An opening 255 may be formed at a central portion of the plate 250 to allow air to flow therethrough. In addition, a first hole 258 may be formed below the opening 255 to allow the supply duct 244 to pass through the first hole 258, such that the burner 240 may be primarily supported on the plate 250. The positioning of the supply duct 244 through the first hole 258 may prevent the burner 240 from moving in a vertical direction. One or more second holes 259 through which the one or more protrusions 245 of the burner body 242 pass may be formed in the plate 250 to prevent the burner 240 from moving in a horizontal direction and rotating.

A first partition 254 for guiding air flow and partitioning, or isolating, the flames generated by the burner 240 from the air flow, may be formed at the plate 250, adjacent to the opening 255. The first partition 254 may face the burner body 242 and be formed in substantially the same shape as the burner body 242. The first partition 254 may protrude toward the cover 270 from the plate 250. That is, the first partition 254 may protrude from the plate 250 in a direction away from the rear wall 216 of the cavity 210. The burner body 242 may be positioned outside the first partition 254 while installed on the plate 250, such that the burner body 242 covers the outside of the first partition 254. In this case, the burner body 242 may be in contact with or separated from an outer surface of the first partition 254.

A second partition 254A may be provided at an upper end of the first partition 254, connecting the two opposite ends of the first partition 254. The second partition 254A may also partition the air flow from the flames. Rotation of the fan 260 causes air in the cooking chamber 211 to pass through a region where the first partition 254 and the second partition 254A surround the opening 255 and guide the air through the opening 255. In this case, the partitions 254 and 254A may partition the air flow and the flames and guide the air flow.

Since the air flow and the flames are partitioned by the partitions 254 and 254A, a flame blowing phenomenon (flame instability phenomenon) due to the air flow may be prevented, and air at a periphery of the burner 240 may be rapidly heated to a target temperature.

One or more fastening portions 253 for fixing the plate 250 to the rear wall 216 of the cavity 210 may be formed at the plate 250. The fastening portion 253 may protrude toward the rear wall 216 of the cavity 210 from the plate 250. The fastening portion(s) 253 may include a first extension extending horizontally extended from the plate 250, and a second extension extending vertically from an end of the first extension. A fastening hole for receiving a fastener may be formed in the second extension 253B. When the fastening portions 253 of the plate 250 are fastened to the rear wall 216 of the cavity 210, the plate 250 and the rear wall 216 of the cavity 210 may be spaced apart from each other, and an air passage P in which the heated air flows may be formed between the plate 250 and the rear wall 216. The fan 260 may be positioned in the air passage P.

Figure 3:
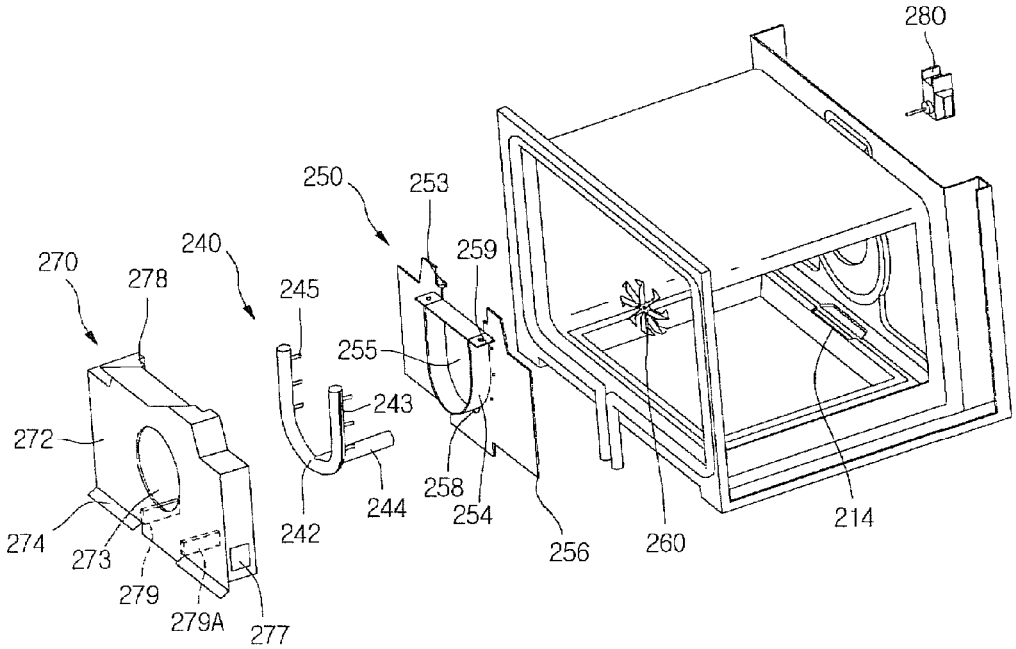
FIG. 3 is an exploded perspective view of a burner assembly of the oven shown in FIG. 2, in accordance with an embodiment as broadly described herein.

One or more communication openings 256 through which the heated air flows may be formed at two opposite lower ends of the plate 250. Accordingly, the air from the air passage P may pass through the communicating openings 256 due to rotation of the fan 260 and flow forward. In FIG. 3, as an example, two communicating openings 256 are formed, but the number of communicating openings is not limited, and various numbers and/or arrangements of openings may be appropriate.

While the plate 250 is installed on the rear wall 216 of the cavity 210, a lower central portion of the plate 250 (a portion between the two communicating holes 256) may be in contact with the bottom wall 212 of the cavity 210.

The cover 270 may cover the burner 240 at the front of the plate 250. The cover 270 may include a cover body 272. The burner 240 may be positioned between the cover body 272 and the plate 250. The cover 270 may be coupled with the rear wall 216 of the cavity 210. The cover 270 may define a burner chamber C together with the plate 250, and a part of the bottom wall 212 of the cavity 210.

The cover 270 may include one or more inlets 273 to guide air from the cooking chamber 211 into the burner chamber C, and one or more outlets for discharging the air heated by the burner 240 to the cooking chamber 211.

For example, the inlets 273 may be formed at a central portion of the cover member 270. The outlets may include at least one side outlet 277, at least one upper outlet 278, and at least one lower outlet 279. A contact portion 275 of the cover 270 contacting the bottom wall 212 of the cavity 210 may be provided at the lower central portion of the cover 270. A part of the cover 270 may be cut and curved forward to form discharge guides 274 at the two ends of the contact portion 275. The cut portion forming the discharge guide 274 may define the lower outlet 279. The discharge guide 274 may be inclined downward toward the front (a direction facing the oven door 220) from the cover 270, as shown in FIG. 3. The discharge guide(s) 274 may face the communicating opening(s) 256 formed in the plate 250.

Accordingly, the air passing through the communicating opening 256 passes through the lower outlet 279 and then may flow toward the oven door 220, guided by the discharge guide 274. That is, the air discharged through the lower outlet 279 by the discharge guide 274 does not directly flow toward the inlet 273, but may flow toward the oven door 220 to thereby fully and uniformly heat the cooking chamber 211.

Figure 4:
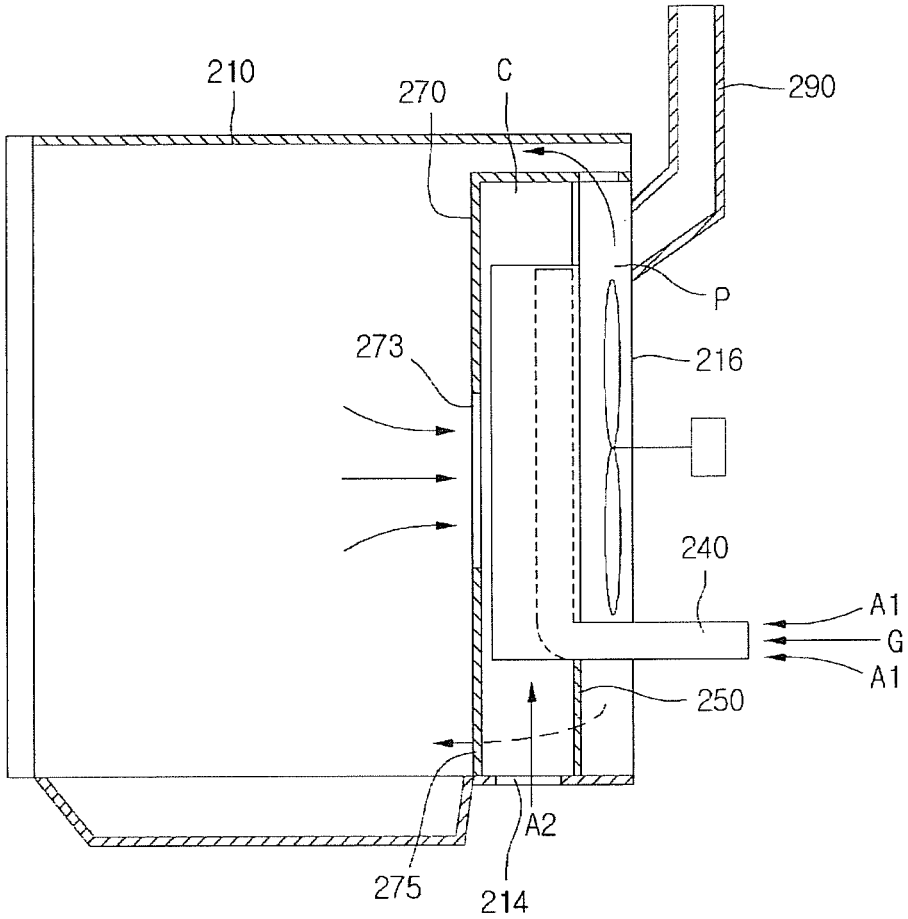
FIG. 4 is a cross-sectional view taken along line A-A of FIG. 2.
Figure 5:
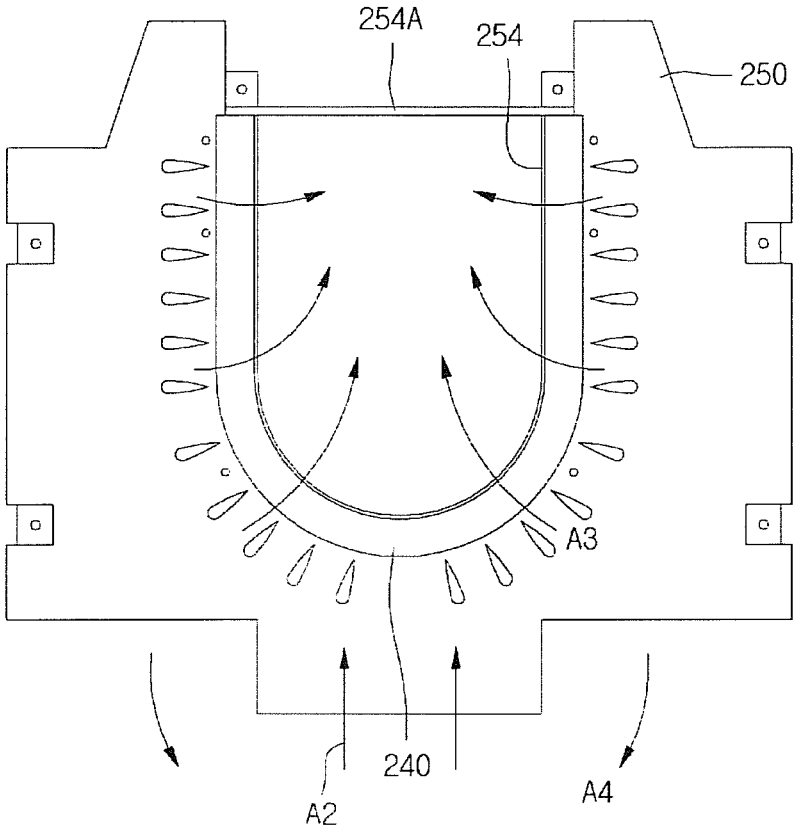
FIG. 5 illustrates a flame pattern generated by a burner installed on a plate of the burner assembly shown in FIG. 3.

Referring to FIG. 4, when gas G is injected from the nozzle into the supply duct 244 at high speed, external air A1 (air from outside the cavity 210) near the supply duct 244 is supplied to the supply duct 244 together with the gas G. In this case, the external air A1 is supplied to the supply duct 244 due to a pressure difference when a peripheral portion of the gas supplied to the supply duct 244 is at low pressure.

Accordingly, when the air is supplied to the supply duct 244 in this manner, air required for burning the mixed gas may not sufficiently be supplied to the burner body 242. In this case, an incomplete burning phenomenon of the mixed gas may occur, and as a result, an increased amount of carbon monoxide may be generated due to the incomplete burning.

Accordingly, in order to prevent incomplete burning, an air inlet 214 to which additional air A2 for burning the mixed gas flows may be formed in the bottom wall 212 of the cavity 210. The air inlet 214 may be provided in a region corresponding to a region of the bottom wall 212 between the contact portion 275 of the cover 270 and the rear wall 216 of the cavity 210, in detail, a region of the bottom wall 212 between the contact portion 275 and the lower central portion of the plate 250, defining the burner chamber C. Accordingly, the air passing through the air inlet 214 may flow between the contact portion 275 of the cover 270 and the lower central portion of the plate 250 and then toward the burner 240.

In this embodiment, in order to prevent the air A2 flowing through the air inlet 214 from being mixed with the air in the cooking chamber 211, the cover 270 and the plate 250 may contact a wall (for example, the bottom wall 212) with the air inlet 214. That is, in this embodiment, the contact portion 275 of the cover 270 and the lower central portion of the plate 250 may contact the bottom wall 212 having the air inlet 214 formed therein.

Alternatively, the air inlet 214 may be formed at one or both of the side walls of the cavity 210.

Further, in order to prevent the air A2 flowing through the air inlet 214 from being influenced by air A4 discharged through the communicating opening(s) 256 of the plate 250, a partition 279A for partitioning the flowing air A2 and the discharged air A4 may be formed at the cover 270 or the plate 250. That is, the partition 279A may be provided between the cover 270 and the plate 250.

In embodiments as broadly described herein, for example, the partition 279A is formed at the cover 270 and extends back toward the rear wall 216 of the cavity 210. Alternatively, when the partition 279A is formed at the plate 250, the partition 279A may extend forward toward the cover 270 from the plate 250.

In embodiments as broadly described herein, since the air outside the cavity 210 may be additionally supplied to the burner chamber C through the air inlet 214, generation of carbon monoxide due to the incomplete burning of the mixed gas may be decreased.

In this embodiment, since the contact portion 275 of the cover 270 contacts the bottom wall 212 of the cavity 210, the air inlet 214 is not exposed outside while the oven door 220 is opened. Further, the contact portion 275 of the cover 270 is positioned at the front of the air inlet 214, that is, between the air inlet 214 and the recessed portion 213, and it may be possible to prevent food and the like from flowing into the air inlet 214 during cooking or cleaning of the cavity 210.

Hereinafter, operation of the burner assembly will be described.

When the burner assembly is turned on, the mixed gas is supplied to the burner 240 to generate flames in the burner 240. In addition, when the fan motor 280 is turned on, the fan 260 rotates. As the fan 260 rotates, the air A3 in the cooking chamber 211 flows into the burner chamber C through the inlet 273 formed in the cover 270. The air flowing into the burner chamber C is guided by the partitions 254 and 254A into the air passage P through the opening 255 in the plate 250. In order to minimize the influence of the air A3 on the flames generated by the burner 240, the partitions 254 and 254A may contact the cover 270.

Since the burner chamber C and the air passage P are heated by the flames of the burner 240, the air flowing to the air passage P is heated as the air flows. In addition, the air A4 flows from the air passage P through the communicating opening(s) 256 of the plate 250, and then is discharged to the cooking chamber 211 through the side outlet(s) 277 and the lower outlet(s) 279 of the cover 270. The remainder of the air in the air passage P may be directly discharged to the cooking chamber 211 through the upper outlet(s) 278 of the cover 270.

Figure 2:
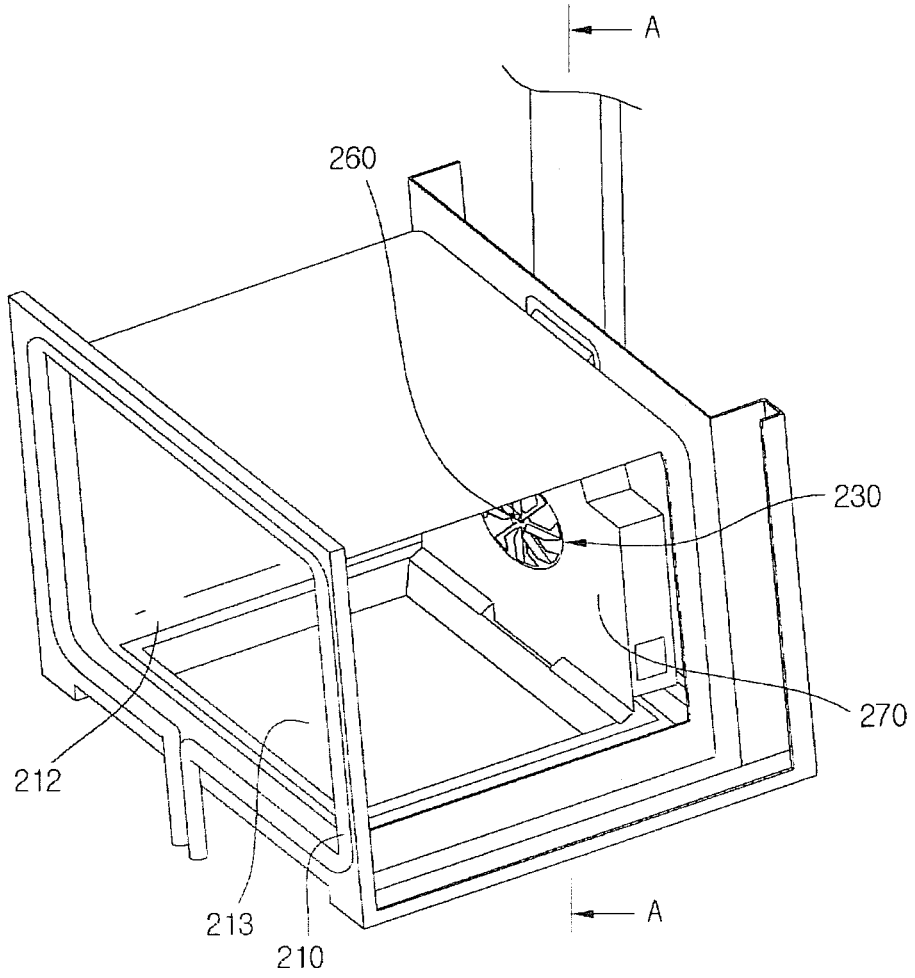
FIG. 2 is a perspective view of a cooking chamber of an oven shown in FIGS. 1A and 1B.
Figure 6:
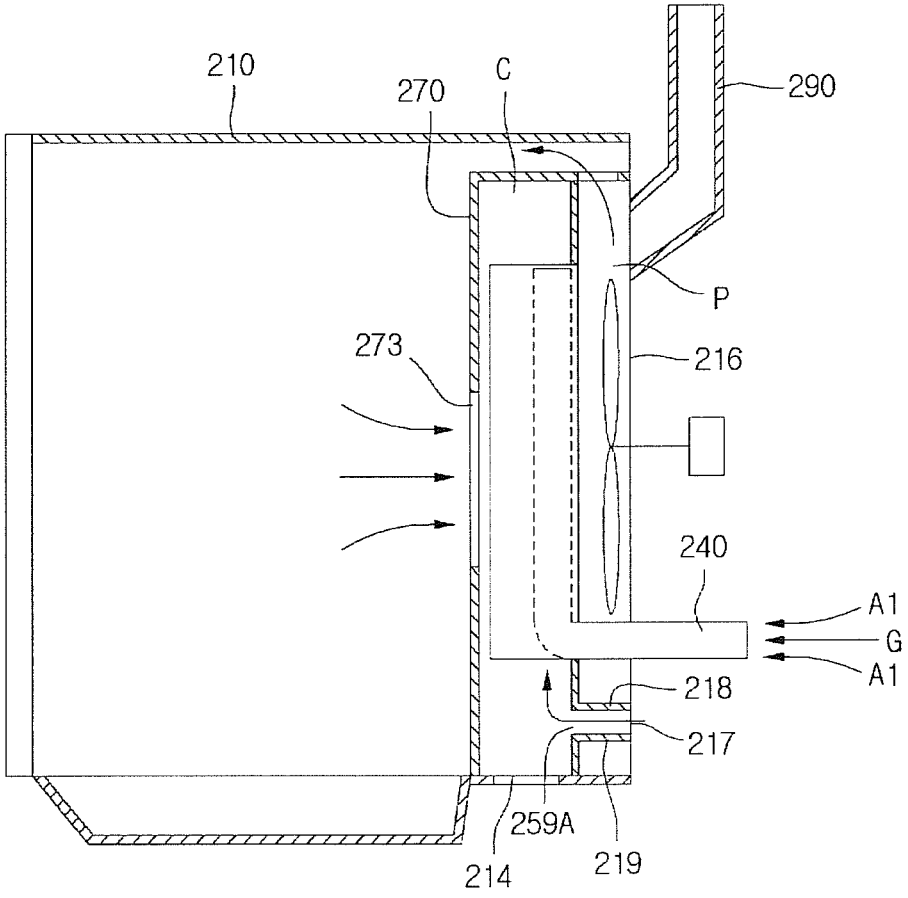
FIG. 6 is a cross-sectional view taken along line A-A of FIG. 2 according to another embodiment as broadly described herein.

FIG. 6 is a cross-sectional view taken along line A-A of FIG. 2, according to another embodiment as broadly described herein.

Referring to FIG. 6, an air inlet 217 for supplying air to the burner chamber C may be formed at the rear wall 216 of the cavity 210. Air guides 218 and 219 may be provided between the plate 250 and the rear wall 216 of the cavity 210 so that the air flowing through the air inlet 217 may stably flow into the burner chamber C. The air guides 218 and 219 may be formed separately from the plate 250, or may be integrally formed with the plate 250. An opening 259A may be formed in the plate 250 to guide air flowing through the air inlet 217 into the burner chamber C.

In the above embodiments, the burner assembly is installed on the rear wall of the cavity, within the cavity. However, the burner assembly may also be installed on the rear wall of the cavity, outside the cavity.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

Embodiments as broadly described herein are directed to a gas oven range.

In one embodiment, a gas oven range as broadly described herein may include a cavity to form a cooking chamber in which foods are cooked; and a burner assembly installed in the cavity, wherein the burner assembly includes: a burner having flame holes, and a cover member to cover the burner to form a burner chamber, and having an inlet to flow air of the cooking chamber into the burner chamber and an outlet to discharge the air heated by the burner, and wherein an air inlet for flowing air outside the cavity to the burner chamber is formed on one wall of the cavity.

In another embodiment, a gas oven range as broadly described herein may include a cavity to form a cooking chamber in which foods are cooked; a burner disposed inside the cavity and having a plurality of flame holes; and a cover member disposed on a first wall of the cavity, covering the burner to form a burner chamber, and having an inlet flowing air of the cooking chamber into the burner chamber and an outlet discharging the air heated by the burner, in which an air inlet for flowing air outside the cavity to the burner chamber is formed on a second wall of the cavity.

In still another embodiment, a gas oven range as broadly described herein may include a cavity to form a cooking chamber in which foods are cooked; a burner disposed inside the cavity and having a plurality of flame holes; and a cover member disposed on a first wall of the cavity, covering the burner to form a burner chamber, and having an inlet flowing air of the cooking chamber into the burner chamber and an outlet discharging the air heated by the burner, in which an air inlet for flowing air outside the cavity to the burner chamber is formed on the first wall of the cavity.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A gas cooking apparatus, comprising:

a cavity that defines a cooking chamber; and a burner assembly installed in the cavity, wherein the burner assembly includes:

a burner having a plurality of flame holes;

a plate that supports the burner;

a cover coupled in the cavity to cover the burner and define a burner chamber enclosing the burner, the cover having an inlet to guide air from the cooking chamber into the burner chamber and at least one outlet to discharge air heated by the burner; and at least one air inlet formed at one wall of the cavity to introduce air from outside the cavity into the burner chamber, wherein the at least one air inlet includes:

a first air inlet, including an opening formed in a bottom wall of the cavity, at a position corresponding to a bottom end of the burner chamber; and a second air inlet including:

an opening formed in a rear wall of the cavity; and an air guide that extends between the opening in the rear wall of the cavity and a corresponding opening in the plate so as to guide external air into the burner chamber formed between the cover and the plate.

2. The apparatus of claim 1, further including a partition provided in the burner chamber to partition the air flowing through the least one air inlet from the air heated by the burner in the burner chamber.

3. The apparatus of claim 2, wherein the plate is provided between the cover and a corresponding peripheral wall of the cavity such that the burner chamber is defined by a space formed between the cover and the plate with the partition disposed between the cover and the plate.

4. The apparatus of claim 3, wherein the partition extends between the cover and the plate so as to partition a space therebetween.

5. The apparatus of claim 2, wherein the plate is provided between the cover and a corresponding peripheral wall of the cavity such that the burner chamber is defined by a space formed between the cover and the plate, having the first air inlet formed at the bottom wall of the cavity, at a portion of the bottom wall corresponding to a space formed between the cover and the plate.

6. The apparatus of claim 5, wherein the plate contacts the bottom wall of the cavity.

7. The apparatus of claim 5, further including a fan provided in a space formed between the plate and the peripheral wall of the cavity.

8. The apparatus of claim 7, further including a fan motor that rotates the fan.

9. The apparatus of claim 1, further including:

a recessed portion formed in the bottom wall of the cavity, wherein a lower end of the cover contacts the bottom wall of the cavity between the recessed portion and the at least one air inlet.

10. The apparatus of claim 1, wherein the burner assembly is installed at a rear wall of the cavity in the cooking chamber.

11. The apparatus of claim 1, further including a discharge port provided at a rear wall of the cavity through which burned gas is discharged out of the cavity.

12. The apparatus of claim 1, wherein the burner includes a burner body and a supply pipe through which a mixture of gas and air is supplied to the burner body.

13. The apparatus of claim 12, wherein the burner body is formed in a rounded shape to increase a flame generation area.

14. The apparatus of claim 13, wherein the burner body has a U shape.

15. The apparatus of claim 13, wherein the burner body has a hollow cylindrical shape, and wherein the plurality of flame holes is formed on an outer peripheral surface of the burner body.

16. The apparatus of claim 15, wherein the plurality of flame holes is formed on an outer side on the outer peripheral surface of the burner body.

17. The apparatus of claim 13, wherein the supply pipe is connected to a lower portion of the burner body so that the mixture of gas and air supplied to the burner body is divided to flow into two opposite sides of the burner body to generate even flames throughout the burner body.

18. The apparatus of claim 12, wherein the burner body includes a plurality of protrusions that penetrates into the plate to couple the burner with the plate.

19. The apparatus of claim 12, wherein the supply pipe penetratingly extends through the rear wall of the cavity to a rear side of the rear wall of the cavity.

20. A gas cooking apparatus, comprising:

a cavity that defines a cooking chamber;

a burner installed in the cavity and including a plurality of flame holes;

a cover coupled in the cavity so as to cover the burner and define a burner chamber;

an inlet and an outlet formed in the cover, the inlet guiding air from the cooking chamber into the burner chamber and the outlet discharging air heated by the burner from the burner chamber into the cooking chamber;

at least one air inlet formed at a peripheral wall of the cavity to guide air from outside the cavity into the burner chamber; and a plate on which the burner is installed, wherein the cover is coupled to a rear wall of the cavity, wherein the plate having the burner coupled thereto is positioned in a space formed between the cover and the rear wall of the cavity, wherein a space formed between the plate and the cover defines the burner chamber together with a corresponding portion of a bottom wall of the cavity, wherein a space formed between the plate and the rear wall of the cavity defines an air passage in which a fan is installed, and wherein the at least one air inlet includes:

a first air inlet, including an opening formed in the bottom wall of the cavity, at a position corresponding to a bottom end of the burner chamber; and a second air inlet including:

an opening formed in the rear wall of the cavity; and an air guide that extends between the opening in the rear wall of the cavity and a corresponding opening in the plate so as to guide external air into the burner chamber formed between the cover and the plate.

* * * * *